United States Patent [19]

MacLean

[11] Patent Number: 4,602,588

[45] Date of Patent: Jul. 29, 1986

[54] ANCHOR

[76] Inventor: John A. MacLean, c/o CrabClaw Marine, Inc., 21750 Doral Rd., Waukeshaw, Wis. 53186

[21] Appl. No.: 651,587

[22] Filed: Sep. 14, 1984

[51] Int. Cl.[4] ..... B63B 21/034

[52] U.S. Cl. ..... 114/301

[58] Field of Search ..... 114/294–295, 114/297–311; 52/155; D12/215

[56] References Cited

U.S. PATENT DOCUMENTS

| | | | |
|---|---|---|---|
| 172,535 | 1/1876 | Whitecar | 114/310 |
| 1,356,481 | 10/1920 | Windle | 114/300 |
| 1,836,586 | 12/1931 | Gibb | 114/300 |
| 2,522,191 | 9/1950 | Pillow | 114/301 |
| 3,066,636 | 12/1962 | Churchman et al. | 114/300 |
| 3,158,127 | 11/1964 | Gallaugher | 114/300 |
| 3,402,689 | 9/1968 | James | 114/300 |

*Primary Examiner*—Galen L. Barefoot
*Assistant Examiner*—Jesûs D. Sotelo
*Attorney, Agent, or Firm*—Mason, Kolehmainen, Rathburn & Wyss

[57] ABSTRACT

An anchor for boats comprises a hollow body having an outer shell of molded resinous plastic material. The body includes an integral stem having a lower end integrally joined to a ballast chamber elongated to extend transversely of the stem in opposite directions. A pair of claws are integrally formed to project transversely outwardly of the ballast chamber and transversely of the stem axis for engagement with a supporting bottom surface under water. The outer shell is designed to withstand loads imposed by an anchor line between the stem and a bottom engaging fluke or claw. Ballast material such as metal punchings and scrap pieces, and/or concrete is carried in the shell to provide sufficient anchor weight for causing the flukes or claws to bite to dig into the underwater bottom surface and hold. In one embodiment of the anchor the ballast material includes a plurality of relatively small, dense discrete elements, such as metal punchings, loosely contained in the shell and occupying an aggregate space less than the internal volume of the shell. The ballast moves in the shell providing for a shift in the center of gravity maximizing the effective digging power of the anchor. An opening is included in the shell for introduction of ballast material. The shell in this embodiment includes a lower support for supporting the anchor in a stable condition when stored. The anchor of this embodiment includes a plurality of claws each with an upward sloping base and an upper pointed end that slopes downwardly and outwardly from each pointed end.

34 Claims, 14 Drawing Figures

110
120
122
128
130
132
134
134a
136
144
144a
145
145a
146
147
148
149
149a
149b
150
151
153

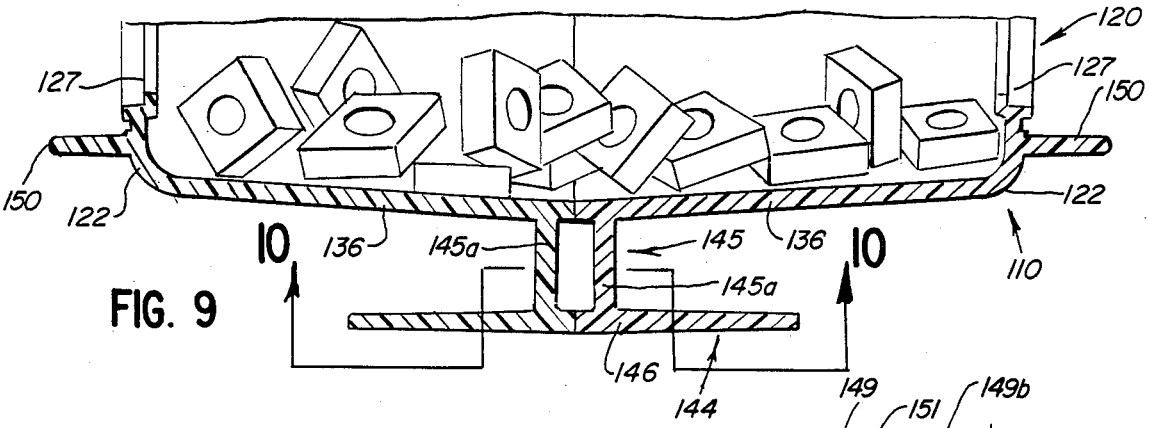
FIG. 9
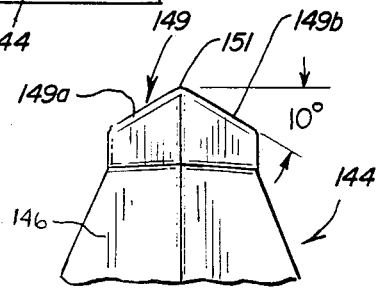
FIG. 11
FIG. 10
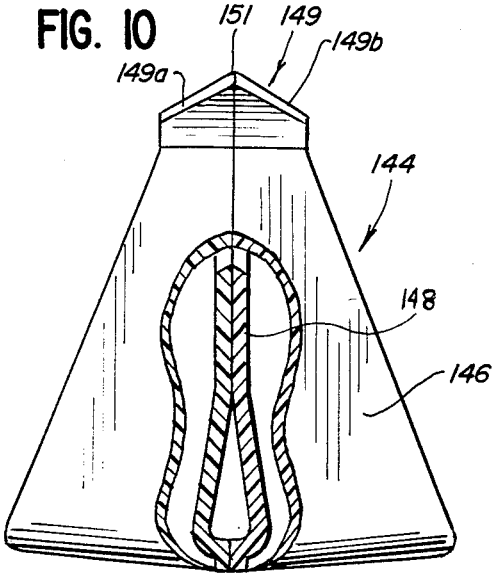
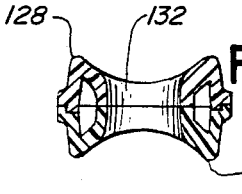
FIG. 13
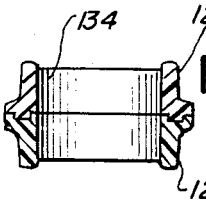
FIG. 14
FIG. 12
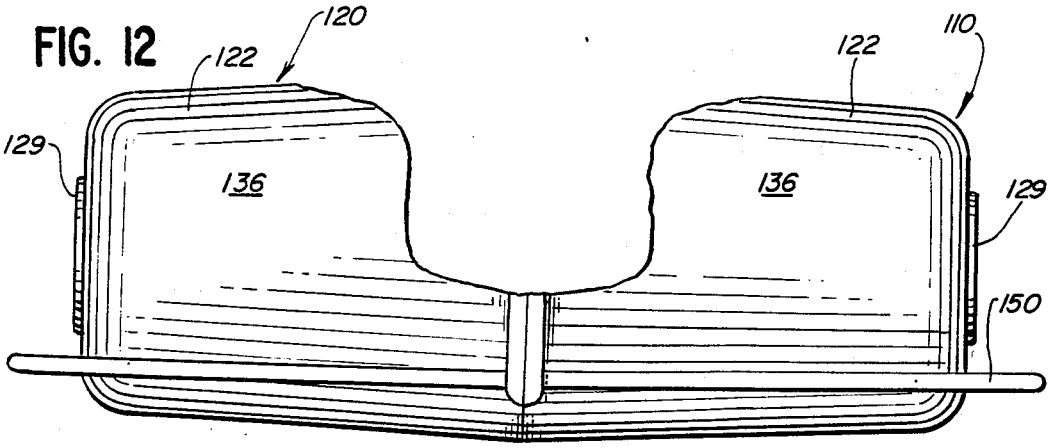

ANCHOR

BACKGROUND OF THE INVENTION

1. Field of the Invention

The present invention relates to anchors and more particularly to a claw type anchor having an outer shell formed of molded plastic material designed to withstand loads imposed between an anchor line attached to a stem and a claw or fluke of the anchor engaged with a bottom surface under water.

2. Prior Art

Presently existing types of claw anchors have numerous problems including high material and manufacturing costs, sloppy appearance, rough edges and high vulnerability to rust and/or corrosion. Some of the anchors presently available are provided with plastic coatings which wear poorly and tend to retain extra moisture which promotes corrosion and marine growth making the anchor slippery and hard to handle, easier to drop and in general, difficult to use effectively.

Some of the plastic coating materials utilized on presently available anchors tend to smooth out or round off and radius the edges of hooks or claws, but these edges should be relatively sharp so that the anchor claws will bite or dig in more effectively. In addition, many anchors presently available have rough edges and lack support in the eye area of the stem, which tends to abraid and cause anchor lines to fail prematurely.

U.S. Pat. Nos. D. 191,726; D. 256,578; 2,522,191; 3,158,127 and 3,402,689 disclose various designs of small boat anchoring devices. A portable small boat anchor sold under the trademark SUPER SINKER is manufactured and offered for sale by Berkley & Company, Inc. of Spirit Lake, Iowa and this anchor (shown in U.S. Pat. No. Des. 256,578) provides a storage capability for holding 50 feet of anchor line wrapped around a drum-like lower section thereof.

OBJECTS OF THE INVENTION

It is an object of the invention to provide a new and improved anchor and more particularly, a new and improved claw or fluke type anchor of the character described having a molded outer shell adapted to withstand loads imposed between an anchor line connected to the stem and a claw or fluke engaging the bottom surface under water.

Yet another object of the present invention is to provide a new and improved anchor of the character described wherein an outer shell provides a hollow body for containing ballast material providing weight for use in helping to engage the anchor with a bottom surface under water.

Yet another object of the present invention is to provide a new and improved anchor of the character described wherein a variety of different ballast materials may be chosen, both for the weight characteristics desired and for economical reasons to provide a lower cost anchor.

Yet another object of the present invention is to provide a new and improved anchor of the character described having a hollow outer shell of molded plastic material and having an interior chamber containing ballast material comprising scrap steel punchings, slugs, washers, nuts, etc.

Still another object of the present invention is to provide a new and improved boat anchor of the character described having a minimum of rough edge portions overall and a smooth outer surface especially effective in resisting marine growth.

Yet another object of the present invention is to provide a new and improved anchor of the character described having an effectively low center of gravity so that improved biting or digging into a bottom surface is achieved with resulting improved holding characteristics.

Yet another object of the present invention is to provide a new and improved anchor of the character described having a stem provided with a convenient hand recess accommodating the fingers of the hand for picking up, manipulating and/or transporting the anchor during use and deployment.

Yet another object of the present invention is to provide a new and improved stem having a shrouded eye for better support and protection of an anchor line with a minimum of abraiding of the line.

Yet another object of the present invention is to provide a new and improved anchor having a cruciform configuration wherein canted lobes are provided to improve digging or biting action of the claws or flukes which extend outwardly of the stem and lobes transversely thereto.

Yet another object of the present invention is to provide a new and improved anchor of the character described having a ballast chamber formed with a canted under surface sloping upwardly and outwardly in opposite directions from a central stem axis and a pair of claws or flukes sloping upwardly and outwardly from the stem axis and extending generally transverse to the longitudinal extension of the ballast chamber.

Yet another object of the present invention is to provide a new and improved anchor having improved gripping and holding characteristics for use with boats and the like.

Yet another object of the present invention is to provide a new and improved anchor of the character described including a hollow body partially filled with relatively small, dense, discrete ballast elements loosely contained in the body allowing relative movement of the ballast elements in the body.

Yet another object of the present invention is to provide a new and improved anchor of the character described including a lower edge for supporting the anchor in a stable condition on a surface.

Yet another object of the present invention is to provide a new and improved anchor of the character described including at least one claw with a base including a pointed upper end for holding engagement with an underwater bottom surface.

Yet another object of the present invention is to provide a new and improved anchor of the character described including a ballast chamber with an opening for introducing ballast into the chamber and a watertight closure for the opening.

BRIEF SUMMARY OF THE INVENTION

The foregoing and other objects and advantages of the present invention are accomplished in a new and improved anchor for boats and the like comprising a hollow body having an outer shell of molded resinous plastic material. The body is formed with an elongated stem having a lower end integrally joining a ballast chamber that is elongated to extend transversely of the longitudinal axis of the stem in opposite directions therefrom. A plurality of flukes or claws project outwardly of the ballast chamber transversely of the stem axis and transversely from opposite sides of the ballast chamber. The underside or surface of the ballast chamber and the claws or flukes are canted to slope upwardly and outwardly from an apex at the central stem axis so that as the anchor comes to rest on a bottom surface, the stem automatically tends to tilt away from a vertical axis so that one of the claws always engages the bottom and bites or digs in for holding the anchor securely in place. In an alternative embodiment of the present invention the ballast chamber of the body is partially filled with a plurality of relatively small, dense, discrete ballast elements loosely contained in the chamber for relative movement in response to movement of the anchor. The ballast chamber includes an opening for the introduction of ballast material and may be closed by a waterproof closure. The alternative embodiment also includes claws each with a lower edge for supporting the anchor in a stable condition on a surface. Each claw includes a pointed upper end for holding engagement with an underwater bottom surface. A web joins the base to each claw.

DESCRIPTION OF THE DRAWINGS

For better understanding of the present invention reference should be had to the following detailed description taken in conjunction with the claims, in which:

FIG. 9 is a partial section view of the lower portion of the alternative anchor looking in the direction of arrows 9—9 of FIG. 5;

FIG. 10 is a partial section view of a claw of the alternative anchor looking in the direction of arrows 10—10 in FIG. 9;

FIG. 11 is a bottom plan view of a tip of a claw of the alternative anchor looking in the direction of arrows 11—11 in FIG. 5;

FIG. 12 is a side elevation view of the ballast chamber of the alternative anchor looking in the direction of arrows 12—12 in FIG. 5 with the upper mid-section removed for clarity;

FIG. 13 is a section view of the upper end of the stem of the alternative anchor at the rope eye looking in the direction of arrows 13—13 in FIG. 5; and FIG. 14 is a section view of the stem of the alternative anchor at the molded grip in the handle looking in the direction of arrows 14—14 in FIG. 5.

DESCRIPTION OF THE PREFERRED EMBODIMENT

Figure 1:
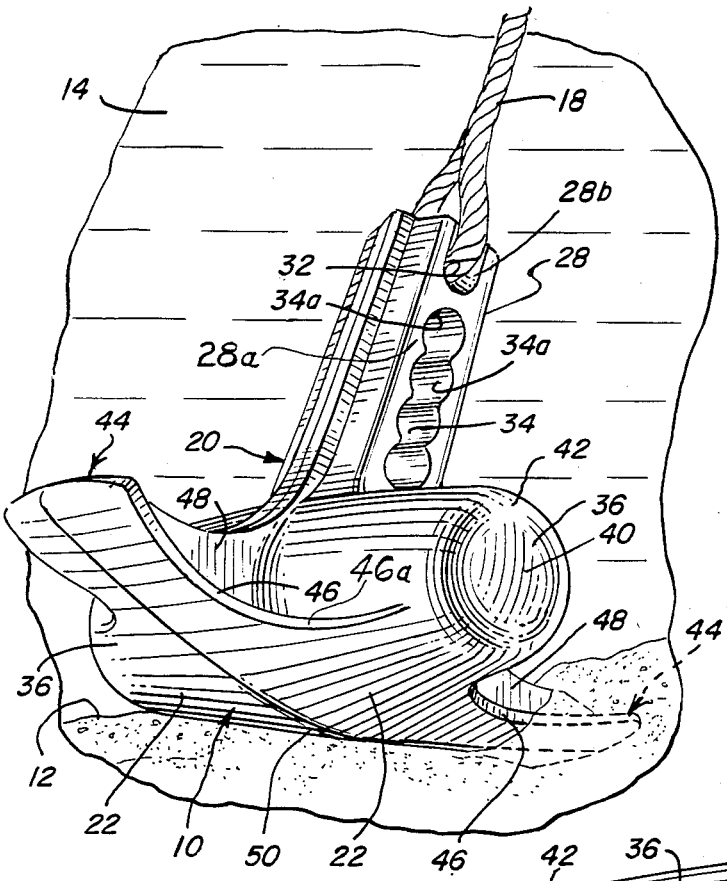
FIG. 1 is a perspective view of a new and improved anchor constructed in accordance with the features of the present invention and shown in a deployed condition with one of the flukes or claws of the anchor engaging the bottom surface in a body of water.

Referring now more particularly to the drawings and initially to FIGS. 1–4, therein is illustrated a new and improved boat anchor 10, which is shown in FIG. 1 in a deployed condition engaging a bottom surface 12 of a body of water 14. The anchor 10 is adapted to be deployed with an anchor line 18 secured thereto and includes a hollow body 20 formed of high strength, molded plastic resin such as an acrylic or polycarbonate resin having a smooth outer surface that is highly resistant to corrosion and marine growth.

Figure 3:
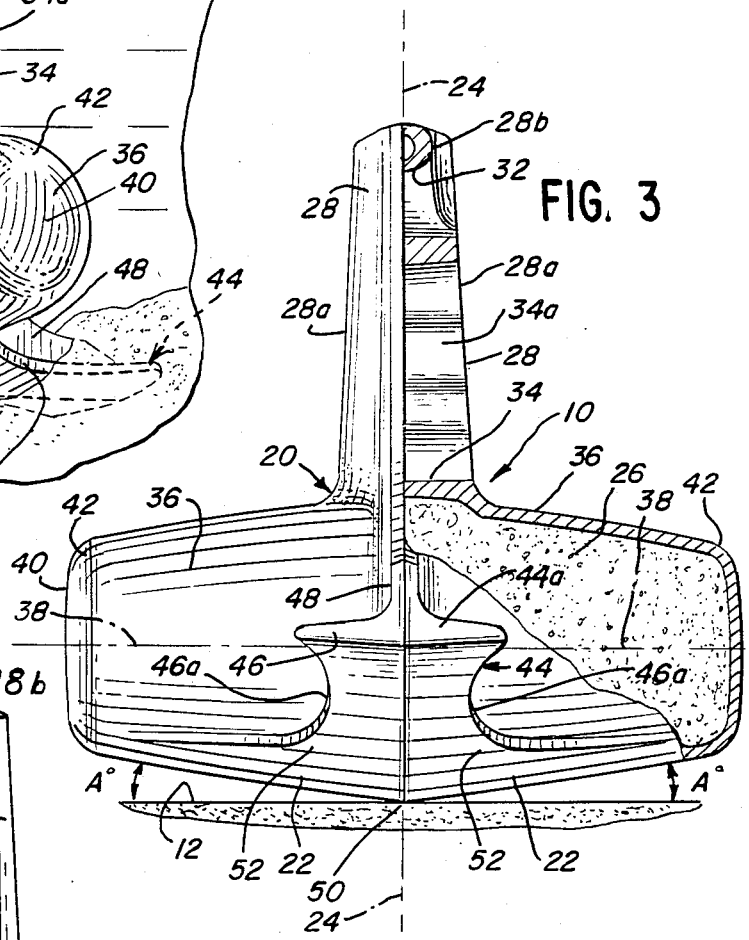
FIG. 3 is a side elevational view of the anchor taken on a plane transverse to that of FIG. 2 with portions broken away and shown in section for better clarity and understanding.

The hollow body 20 is formed in two identical portions or halves 22 which are joined together and sealed against the entry of water into the hollow interior along a joining or parting plane 24 (FIG. 3). The hollow body is filled with appropriate ballast material 26 such as punchings of scrap steel, nuts, bolts, screws or other heavy metal scrap. Concrete, sand, and other low cost, relatively dense materials may also be used. The ballast material 26 only functions to provide the necessary weight for the anchor 10 in order to dig in and hold on the bottom 12 and the ballast material does not carry or withstand any stress or load imposed by the anchor line 18 on the outer shell when the anchor is engaged and holding on the water bottom 12. Accordingly, a wide variety of different ballast materials may be utilized depending on availability and cost. Because, the shell halves 22 are sealed together with a water tight seal, iron and steel can be used effectively as a ballast without fear of rust and corrosion.

Scrap steel punchings from automatic screw machines, punch presses, and other machine tools is particularly well suited for ballast because of the high density and low cost. The smooth surfaced, plastic shell body halves 22 are tightly sealed together along the parting plane 24 in a water tight joint and the interior of the body 20 is maintained in a dry, inert condition for the ballast material.

The body halves 22 are identical and each is formed with an elongated upwardly extending hollow stem portion 28. When the stem portions of each half are joined together, a hollow stem or handle is formed having an upstanding longitudinal axis 30 lying on the parting plane 24. An upper end of each stem portion is formed with an aperture 32 extending transversely inwardly of an outer side face **28*a*, and in order to reduce chaffing and abrasion of the anchor line 18, the stem portions 28 are formed with longitudinal grooves 28*b* projecting upwardly from the eye or aperture 32 to the upper end of the stem. These grooves reduce the amount of lateral, outward projection of the loop end of the anchor line 18** attached to the upper end of the stem.

In accordance with another feature of the present invention, the hollow stem is provided with a hand recess 34 extending transversely through the stem between the opposite outer faces **28*a*. The hand recess is formed with undulating opposite side surfaces 34*a* designed to better accommodate the individual fingers of a person's hand used in grasping the anchor by the stem directly below the eye opening or aperture 32. The stem is thus easily grasped for picking up and deployment by extending the fingers of the hand through the elongated opening 34** and closing the hand around the stem body. This feature insures that the anchor may be handled and manipulated with ease and provides security against inadvertent dropping or misplacement.

In accordance with the present invention, at the lower end of the stem 28, the body halves 22 are integrally joined to a pair of outwardly extending, cup shaped, canting lobes 36 of generally circular transverse cross section. These canting lobes extend outwardly from opposite sides of the parting plane 24 in a direction generally transverse or normal thereto as indicated by a line 38 (FIG. 4) which comprises a longitudinal axis of a ballast chamber which is formed by the body halves and adapted to contain a major portion of the ballast material 26 in the anchor.

When the body halves 22 are joined together along the parting plane 24, the respective canting lobes 36 combine to form the relatively large ballast chamber and this results in a center of gravity for the anchor 20 as a whole, that is close to the lower end of the elongated the stem axis 30. The respective canting lobes or ballast chamber halves are cup shaped and taper from a maximum circular transverse cross section adjacent the parting plane 24 to a minimum or reduced circular cross-section at the outer ends which are closed by an integral circular end wall 40.

As best illustrated in FIG. 3, the underside of the respective canting lobes, slope upwardly and outwardly of the parting plane 24 at an angle of taper (indicated by the letter A) so that as the anchor comes to rest on a bottom surface 12 an apex 50 is formed at the parting plane 24 on stem axis 30 and the apex acts as a pivot point tending to tilt the anchor stem one way or the other away from the vertical so that the anchor will come to rest with the underside of at least one of the lobes closely engaged with the bottom 12 of the water body 14 in which the anchor is deployed.

Because the undersurfaces of the lobes 36 on opposite sides of the parting plane slope upwardly and outwardly of the stem axis 30, the stem does not tend to stay in a truly vertical position when deployment occurs and the anchor tends to list toward one canting lobe or the other. This greatly aids in promoting a biting or digging in action to set the anchor into holding engagement with the bottom surface 12, as will be described more fully hereinafter.

The frustoconical side wall portions of respective canting lobes 36 are joined to circular end walls 40 in arcuately rounded annular transitions 42 and this minimizes rough edges or sharp corners on the outer ends of the elongated ballast chamber.

Figure 2:
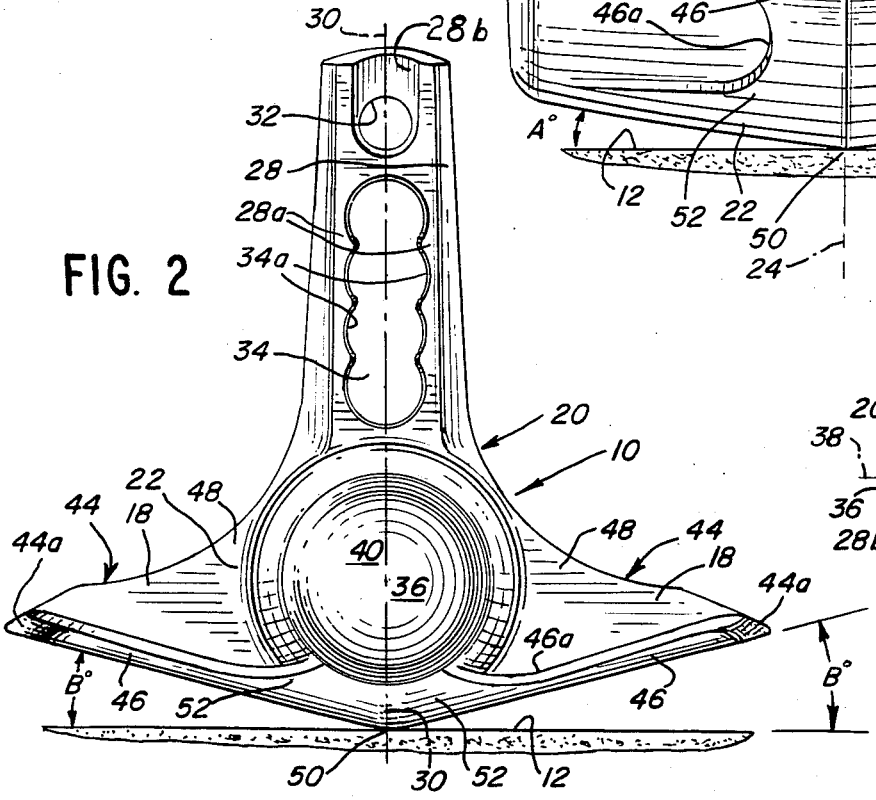
FIG. 2 is a side elevational view of the anchor.
Figure 4:
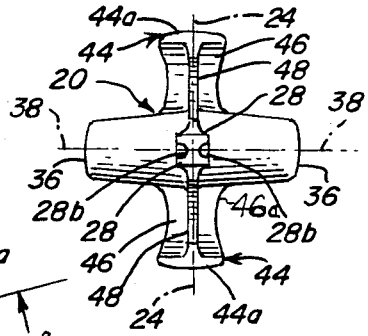
FIG. 4 is a top plan view of the anchor looking downwardly thereon.
Figure 5:
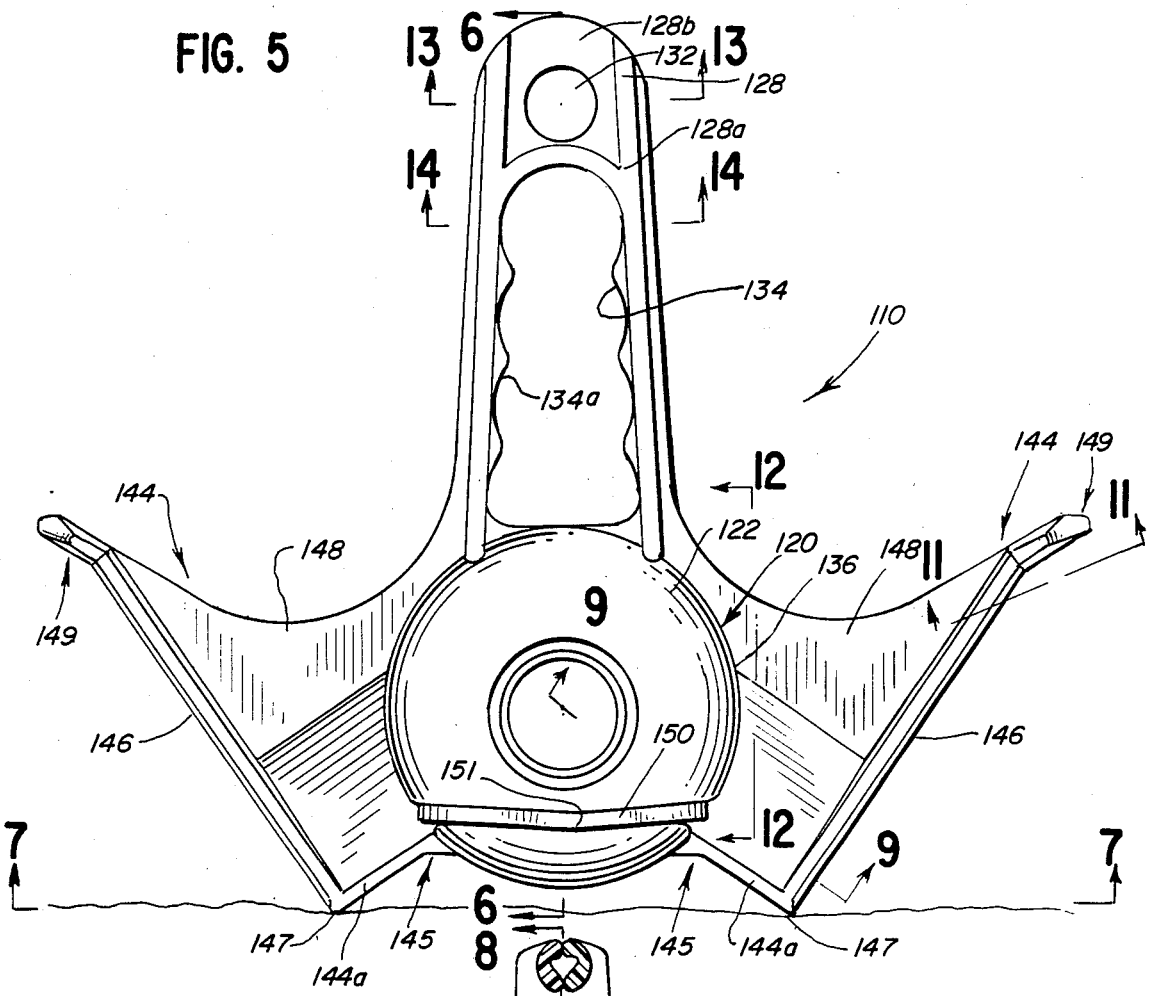
FIG. 5 is an end elevational view of an alternative embodiment of the anchor illustrated in FIGS. 1–4.
Figure 6:
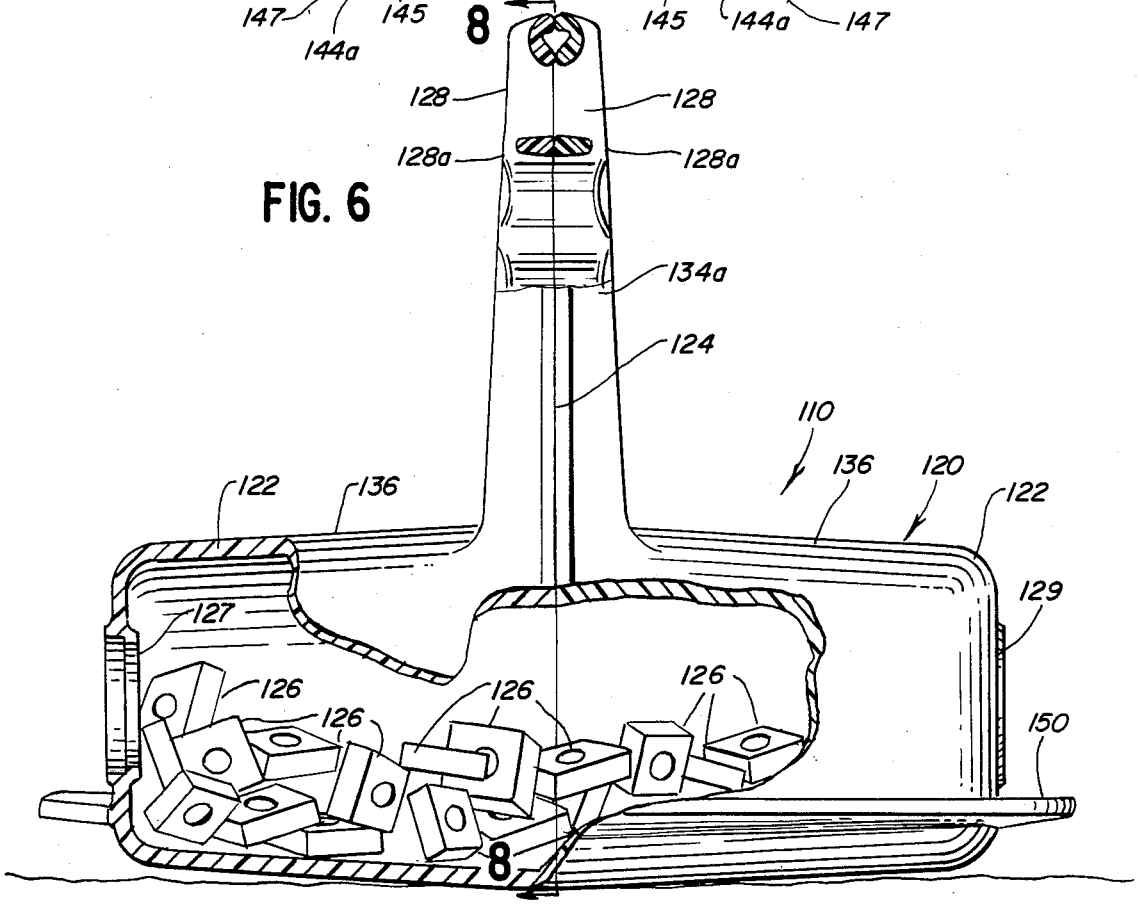
FIG. 6 is a side vertical view of the alternative anchor looking in the direction of arrows 6—6 of FIG. 5 with portions broken away.
Figures 7, 8:
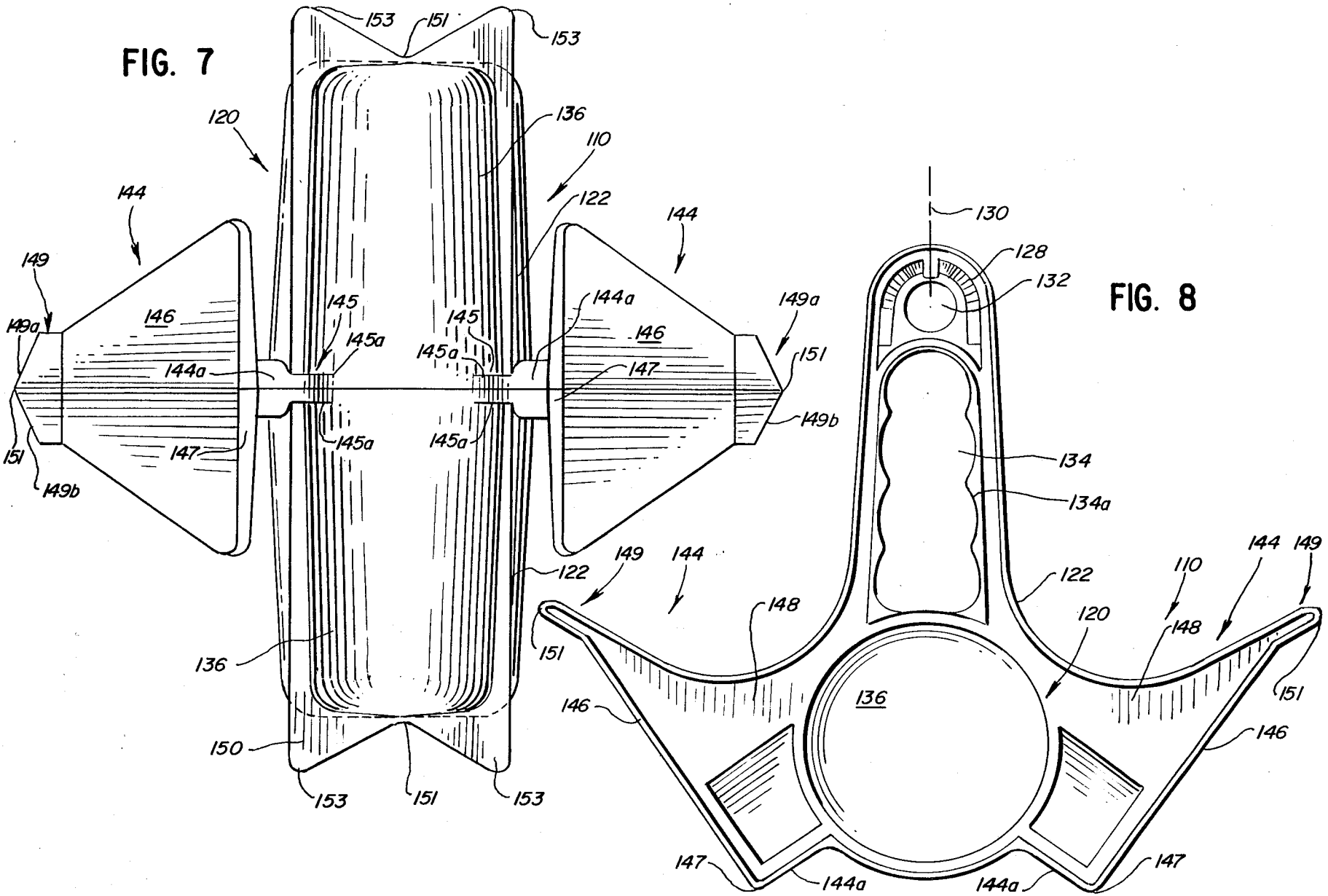
FIG. 7 is a bottom plan view of the alternative anchor looking in the direction of arrows 7—7 of FIG. 5.
FIG. 8 is an vertical section view of the alternative anchor looking in the direction of arrows 8—8 in FIG. 6.

In accordance with the present invention, the anchor 10 includes a pair of claws or flukes 44 designed to bite and dig into holding engagement on the bottom surface 12 of a body of water when the anchor is deployed. The flukes or claws 44 extend oppositely outwardly of the stem axis 30 along the parting plane 24 transverse to the canting lobes, and each claw or fluke is formed by joined together, facing portions of the respective body halves 22. As best shown in FIG. 4, each claw or fluke has a transverse cross section of inverted T-shape that is formed by a lower flange 46 and an integral upstanding web 48. The lower flanges of the claws 44 are canted and taper upwardly and outwardly from the stem axis 30 at an angle "B" as shown in FIG. 2, and the angle "B" is generally greater than the slope angle "A" on the underside of the lobes 36. The difference in slope angles results in the anchor tending to list or tilt more in the direction of a claw than in the direction of the lobes thus insuring that the claw will bite into the bottom surface. Because of the upwardly sloping undersurfaces of the lobes 36 and the claw flanges 46, a tilting point or apex 50 is formed on the bottom of the anchor body 12 at the lower end of the stem axis 30. When the anchor is deployed and sinks to the bottom 12, the apex at the center of the cruciform-shaped claws and lobes generally touches the bottom surface first and thereafter, the stem axis pivots or tilts so that at least one claw 44 will engage and dig in as shown in FIG. 1.

The base flanges 46 of each claw 44 ar formed with inwardly concave, side edges **46*a* and these edges blend smoothly into the adjoining wall portions of the sidewalls of the canting lobes 36 in generally triangular shaped gussets 52 (FIG. 3). At the outer end each claw is provided with an end surface 44*a* which is convexly curved and which slopes upwardly and inwardly from a lower edge toward the stem as best shown in FIG. 2. This slope provides a sharp lower edge at the outer end of each claw to insure excellent holding and digging characteristics so that the claw will bite into the bottom surface 12 and securely hold the anchor in position against pull exerted on the stem 28 by the anchor line 18. As best shown in FIG. 3, the webs 48 of the flukes or claws 44 taper from a maximum height or depth adjacent to or tangent to the body of the canting lobes 36 of the ballast chamber to a minimum depth adjacent outer ends 44*a* of the claws. The webs are formed by portions of each half 22** of the body shell and taper smoothly into the sloped outer end surfaces of the flukes.

The anchor 10 is strong, easy to handle and functions well when deployed to automatically bite into the bottom and provide secure holding engagement for a boat on the surface of the water. The anchor may be constructed of a variety of different plastic resins of high strength and may utilize a variety of low cost, ballast materials such as scrap metal stampings and punch outs which are usually readily available and low in cost. Because the shell of the body 20 is formed of high strength molded plastic material and is strong enough to withstand any stresses imposed between the bottom engaging claws 44 and the anchor line 18 secured to the stem 28, ballast materials such as sand, rocks, concrete, lead may also be used. Moreover, because the outer shell is formed of strong, durable, molded smooth surfaced plastic material, marine growth and corrosion is discouraged. A novel hand aperture formed in the stem provides for easy handling and manipulation of the anchor. When not in use and stowed aboard a boat or vessel, the anchor line 18 may be criss-crossed in a figure eight pattern between opposite claws 44 in a figure "8" type of pattern and a sizeable length of anchor line may thus be stored directly with the anchor in a neat and compact package.

Referring now more particularly to FIGS. 5–14 therein is illustrated an alternative boat anchor 110. Anchor 110 is similar in many respects to previously described anchor 10 and the following description of anchor 110 will parallel that of anchor 10 for ease of understanding and consistency. Anchor 110 is adapted to be deployed with an anchor line and includes a hollow body 120 formed of high strength, molded plastic resin similar to body 20 of anchor 10.

The hollow body 120 is formed in two identical portions or halves 122 which are joined together and sealed against the entry of water into the hollow interior along a joining or parting plane 124. The hollow body is partially filled with punchings of scrap steel, nuts, bolts, screws or other heavy metal scrap 126. The metal scrap or ballast material 126 occupies an aggregate space less than the internal volume of the hollow body 120 allowing relative movement of the discrete ballast material 126 in the body 120.

Movement of the ballast material 126 allows shifting of the center of gravity of anchor 110. When anchor 110 is on a bottom of a body of water it will not dig in until a hard tug on the anchor line causes a shift of the ballast material shifting the center of gravity to cant anchor 110 to the best angle for digging into the bottom. Prior to shifting of ballast material 126, light pulling on the anchor line does not set anchor 110 and anchor 110 may move or skip along the bottom.

Body halves 122 are identical and each is formed with an elongated upwardly extending hollow stem portion 128. When the stem portions 128 of each half are joined together, a hollow stem or handle is formed having an upstanding longitudinal axis 130 lying on the parting plane 124. An upper end of each stem portion is formed with an aperture 132 extending transversely inwardly of an outer side face **128*a*, and in order to reduce chaffing and abrasion of the anchor line, the stem portions 128 are formed with longitudinal grooves 128*b* projecting upwardly from the eye or aperture 132** to the upper end of the stem. These grooves reduce the amount of lateral, outward projection of the loop end of the anchor line attached to the upper end of the stem.

In accordance with another feature of the present invention, the hollow stem is provided with a hand recess 134 extending transversely through the stem between the opposite outer faces **128*a*. The hand recess is formed with undulating opposite side surfaces 134*a* designed to better accommodate the individual fingers of a person's hand used in grasping the anchor by the stem directly below the eye opening or aperture 132. The stem is thus easily grasped for picking up and deployment by extending the fingers of the hand through the elongated opening 134** and closing the hand around the stem body. This feature insures that the anchor may be handled and manipulated with ease and security against inadvertent dropping or misplacement.

In accordance with the present invention, at the lower end of steam 128, the body halves 122 are integrally joined to a pair of outwardly extending, cup shaped, canting lobes 136 of generally circular transverse cross section. These canting lobes extend outwardly from opposite sides of the parting plane 124 in a direction generally transverse or normal to the longitudinal axis of a ballast chamber defined by hollow body 120.

When the body halves 122 are joined together along the parting plane 124, the respective canting lobes 136 combine to form the relatively large ballast chamber. The respective canting lobes or ballast chamber halves are cup shaped and taper from a maximum circular transverse cross section adjacent the parting plane 124 to a minimum or reduced circular cross-section at the outer ends which are closed by an integral circular end wall.

To provide a bottom engaging surface on the ends of lobes 136, a flange or edge 150 is provided. Flange 150 is undulated at the ends 151 to define a pair of pointed sections 153 that are particularly adapted to dig into a bottom of a lake or similar body of water. The pointed portions 153 provide a digging surface at a location on anchor 110 that would otherwise slide over the bottom until anchor 110 rotated into a bottom engaging orientation.

Anchor 110, like anchor 10, includes a pair of claws or flukes 144 designed to bite and dig into holding engagement on the bottom surface of a body of water when anchor 110 is deployed. The flukes or claws 144 extend oppositely outwardly of the stem axis 130 along the parting plane 124 transverse to the canting lobes, and each claw or fluke is formed by joined together, facing portions of the respective body halves 122. Each claw or fluke is formed by a lower flange or base 146 and an integral upstanding web 148.

Each claw 144 is joined to body 120 by a web 145 defined by identical web members **145*a*. Extending from each web 145 is a lower edge 144*a* of each claw 144 that is a right angle to flanges 146. The line of intersection of each edge 144*a* and flange 146 defines a surface 147 on which anchor 110 may stand when not in use. For example, while anchor 110 is stowed on a boat, it may stand upright on the surfaces 147 in a stable condition. In this position, anchor 110** is less likely to roll over the deck of the boat when the water action causes rocking of the boat.

Each claw 144 is of a wedge or triangular configuration. Flanges 146 slope upwardly and outwardly at an acute angle to the stem axis 124 to a pointed upper end 149. Each upper end 149 slopes downwardly and outwardly relative to surface 146. Each upper end 149 includes side edges **149*a* and 149*b* that are tapered inwardly at approximately a 10° angle to a point 151. Each upper end 149 is also tapered inwardly from lower edges 146 to point 151. The upper end 149 and the point 151** defined by the convergent edges defines a relatively thin projection that can easily dig into a bottom surface.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. An anchor, comprising:

a hollow body having an outer shell of molded resinous plastic material, said body including a stem having a lower end integrally joining a ballast chamber, said ballast chamber being of elongate shape having a centrally positioned longitudinal axis extending transversely outwardly of a longitudinal axis of said stem in opposite directions therefrom, said ballast chamber comprising a pair of outwardly convex cup-shaped lobes symmetrically disposed on opposite sides of said stem axis in co-axial alignment on said centrally positioned longitudinal axis, and a plurality of claws projecting outwardly of said ballast chamber transversely of said stem axis and transversely of opposite sides of said ballast chamber.

2. The anchor of claim 1, wherein said ballast chamber includes a lower surface sloping upwardly and outwardly away from said stem axis in opposite directions for causing said stem axis to tilt away from a vertical position toward an outer end of said chamber when said anchor settles with a portion of said ballast chamber engaging a supporting bottom surface.

3. The anchor of claim 2, wherein each of said claws includes a lower surface sloping upwardly and outwardly away from said stem axis in opposite directions transverse to said opposite directions of slope of said lower surface of said ballast chamber for causing said stem axis to tilt away from a vertical position toward an outer end of one of said claws.

4. The anchor of claim 1 wherein said ballast chamber and said claws have lower surfaces sloping upwardly and outwardly away from said stem axis, said lower surfaces converging at said stem axis providing an apex for tilting said stem to engage one of said claws with supporting bottom material on which the anchor is resting.

5. The anchor of claim 1 wherein said stem is formed with an aperture extending therethrough for receiving fingers of a persons' hand used for grasping said anchor.

6. The anchor of claim 5 wherein said aperture is shaped with an undulating surface on opposite sides for accommodating the individual fingers of a persons' hand spaced longitudinally of said stem.

7. The anchor of claim 5 wherein said stem includes a second aperture extending therethrough for receiving a line used for supporting said anchor.

8. The anchor of claim 7 wherein said second aperture is spaced apart from said first mentioned aperture toward an upper end of said stem.

9. The anchor of claim 1 wherein said shell is formed by a pair of identical hollow half-members joined together on a parting plane extending through said stem axis.

10. The anchor of claim 9 wherein said parting plane divides said claws longitudinally thereof.

11. The anchor of claim 9 wherein said parting plane divides said ballast chamber transversely across a longitudinal axis thereof.

12. The anchor of claim 11 wherein said ballast chamber tapers from a central portion having a maximum transverse cross-sectional area toward a reduced transverse cross-section area at opposite ends thereof outwardly of said parting plane.

13. The anchor of claim 11 wherein said transverse cross-section of said ballast chamber is generally round in shape.

14. The anchor of claim 1 wherein at least one of said claws have a cross-section taken transverse to a direction of outward projection thereof that is generally of an inverted T-shape.

15. The anchor of claim 14 wherein said inverted T-shape cross-section comprises a generally flat lower portion extending laterally outward on opposite sides of said direction of outward projection of said stem axis.

16. The anchor of claim 15 wherein said inverted T-shape cross-section includes a web extending upwardly of said flat lower base portion along said direction of outward projection.

17. The anchor of claim 16 wherein said web tapers from a maximum height adjacent said ballast chamber along said direction of outward projection toward a minimum height adjacent an outer end of said claws.

18. The anchor of claim 15 wherein said flat lower portion of said claw has a tapered outer end surface sloping upwardly and inwardly of a lower claw surface toward said stem and extends transverse to said direction of outward projection.

19. The anchor of claim 15 wherein said lower portion of said claw is shaped with an inwardly concave side edge surface between an outer end of said claw and said ballast chamber.

20. The anchor of claim 19 wherein said lower portion of said claw has an outwardly convex outer end surface joining said inwardly concave side edge surface at an outer corner of said claw.

21. The anchor of claim 1 wherein each of said claws includes a lower edge running generally parallel of said ballast chamber spaced outwardly thereof and below a lower surface thereof for supporting said anchor in a stable condition on a surface with said stem extended upright thereof.

22. The anchor of claim 21 wherein each of said claws includes a base sloping upwardly and outwardly of said lower edge thereof at an acute angle relative to said stem axis.

23. The anchor of claim 22 wherein each of said claws includes a web projecting transversely outward of said ballast chamber on one side thereof joined with said base for supporting the same.

24. The anchor of claim 22 wherein said base of each claw includes a pointed upper end portion for holding engagement with an underwater bottom surface when said anchor is deployed.

25. The anchor of claim 24 wherein said pointed upper end portion of each claw slopes downwardly and outwardly with respect to a lower portion of said base.

26. The anchor of claim 24 wherein said base of each claw includes a pair of opposite side edges tapered inwardly toward said pointed upper end portion from said lower edge thereof.

27. The anchor of claim 1 wherein said ballast chamber includes at least one wall having a port therein for introducing ballast into said chamber and watertight closure means for said port for securing said ballast within said hollow body.

28. The anchor of claim 1 wherein said ballast chamber includes an outer end wall and an additional claw projecting outwardly of said end wall having an outer portion for holding engagment with an underwater bottom surface when said anchor is deployed.

29. The anchor of claim 28 wherein said an additional claw comprises a relatively thin projection with said outer portions having convergent edges.

30. An anchor, comprising:

a hollow body having an outer shell of molded resinous plastic material, said body including a stem having a lower end integrally joining a ballast chamber, said chamber having and elongate shape with a central longitudinal axis extending transversely outwardly of a longitudinal axis of said stem in opposite directions therefrom said ballast chamber formed by a pair of a opposing outwardly convex canting lobes disposed symmetrically on opposite sides of said stem in co-axial alignment on said central longitudinal axis, and a plurality of claws projecting outwardly of said ballast chamber transversely of said stem axis and transversely of opposite sides of said ballast chamber; and ballast means in said ballast chamber comprising a plurality of relatively small, dense, discrete ballast elements loosely contained in said chamber for relative movement therein in response to movement of said anchor.

31. The anchor of claim 30 wherein said ballast elements occupy an aggregate space that is less than the internal volume of said hollow body for permitting relative movement of said discrete ballast elements in said ballast chamber.

32. The anchor of claim 30 wherein said ballast elements comprise scrap metal pieces.

33. The anchor of claim 32 wherein said metal pieces are formed of steel.

34. The anchor of claim 30 wherein said body includes a circumferential edge along ends of said ballast chamber to provide a surface for digging into an underwater bottom surface.

* * * * *